US005682844A

United States Patent [19]

Wittner

[11] Patent Number: 5,682,844

[45] Date of Patent: Nov. 4, 1997

[54] TWIN CRANKSHAFT MECHANISM WITH ARCED CONNECTING RODS

[76] Inventor: John A. Wittner, 922 Briar Wood Cir., West Chester, Pa. 19380

[21] Appl. No.: 777,096

[22] Filed: Dec. 30, 1996

[51] Int. Cl.[6] ..... F02B 75/32

[52] U.S. Cl. ..... 123/52.4; 123/197.3

[58] Field of Search ..... 123/197.3, 197.4, 123/52.4, 78 E, 48 B, 59.6; 74/581

[56] References Cited

U.S. PATENT DOCUMENTS

| | | | |
|---|---|---|---|
| 4,690,113 | 9/1987 | Deland | 123/197.4 |
| 4,809,646 | 3/1989 | Paul et al. | 123/197.4 |
| 5,595,147 | 1/1997 | Feuling | 123/52.4 |

*Primary Examiner*—Marguerite McMahon
*Attorney, Agent, or Firm*—Gregory J. Gore

[57] ABSTRACT

An improved crankshaft connecting rod mechanism provides altered reciprocating motion of a piston attached to the connecting rods. The basic mechanism includes two, geared-together, counter-rotating crankshafts which are transversely aligned along parallel axes of rotation and symmetrically spaced apart. Two connecting rods are similarly aligned and have both ends on one side of the axis of linear reciprocation of a connected piston. The shafts of the two connecting rods are preferably displaced ("bent" in the lateral profile) toward the centerline. This bend in the connecting rod shafts may be of such a magnitude that they overlap during a portion of their motion by nesting together, utilizing male/female profiles on their inner side surfaces. The big ends of the two connecting rods may also be constructed so that they overlap. The connecting rods may have an arced profile that may be designed to flex during tension and compression during the reciprocating cycle of the piston. In this way, changes in the effective overall length of the rod may both increase the swept volume of the piston and beneficially increase the compression ratio at high RPM's. The cylinder, as well as portions of the crankcase, may include-notches or clearance cuts on opposite sides of the cylinder to provide for passage of the connecting rods. This arrangement provides an extremely narrow engine for a two-wheeled vehicle, such as a motorcycle, which not only permits the motorcycle to have a greater angle of lean as it negotiates a curve, but also the use of two counter-rotating crankshafts annuls the gyroscopic effect of the engine and thus the motorcycle will require less force to change direction.

4 Claims, 15 Drawing Sheets

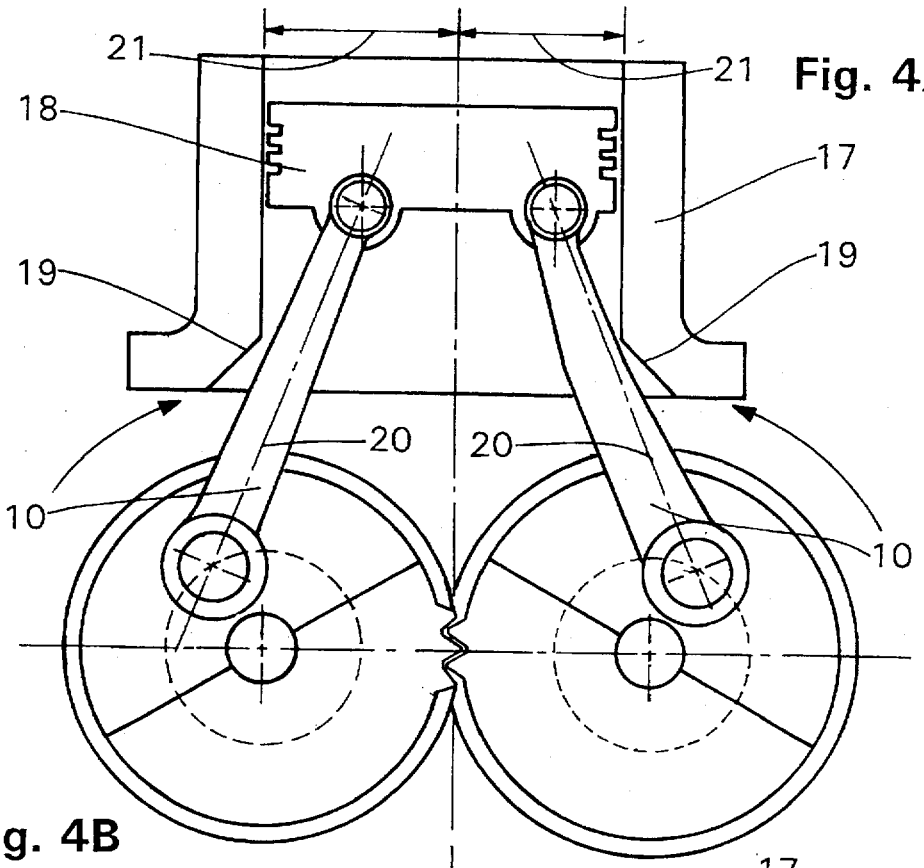
Fig. 4A
Fig. 4B
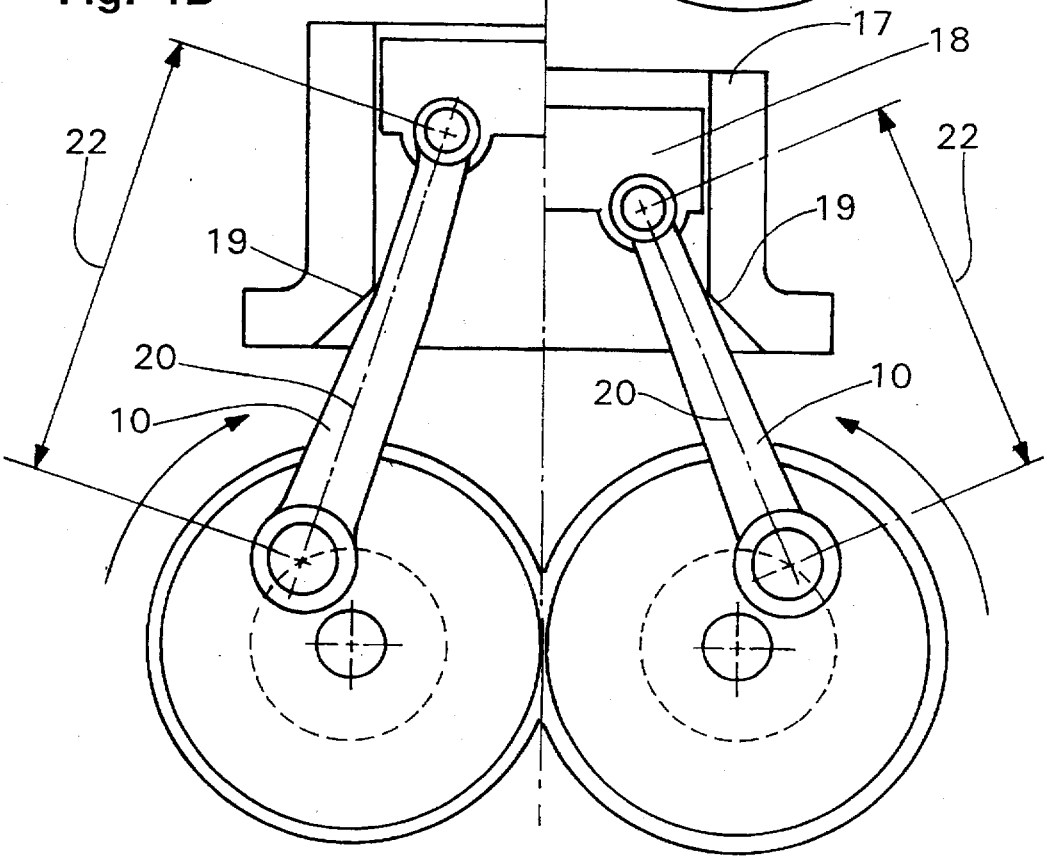

17
24

20
24
23
19

20
10
24

1
8

TWIN CRANKSHAFT MECHANISM WITH ARCED CONNECTING RODS

FIELD OF THE INVENTION

This invention relates in general to machines which produce reciprocating motion of single or multiple elements from rotary motion. More specifically, the invention relates to a connection between a crankshaft and a piston to convert rotary to reciprocating motion. The present invention has particular suitability for use in a single-cylinder motorcycle engine.

BACKGROUND OF THE INVENTION AND DESCRIPTION OF PRIOR ART

In the past, there have been many mechanisms using counter-rotating crankshafts geared together, and two or more connecting rods attached directly to a piston. These mechanisms have been employed in internal combustion engines or fluid pumps. The advantages are many: (1) the elimination of the side thrust on the piston which is possible with two or more opposed connecting rods; (2) to permit a large offset of the crankshaft rotational axis with respect to the axis of reciprocation and thereby achieve useful modifications of conventional piston motion without very high thrust loads on the piston; (3) to achieve a piston motion which may compliment and thereby improve the efficiency of a given thermodynamic or fluid cycle; and (4) to achieve a better balance which is possible with phased-together, counter-rotating crankshafts.

The modern necessity for lightweight, high powered, and more efficient engines has required smaller displacement, more compact engines which operate at higher speeds. Some dual, counter-rotating crankshaft engines have the advantages described above; but cannot be operated at very high speeds, cannot be made compact in important dimensions, and do not afford a very wide choice of functional and structural geometry.

The altered piston timing engine patent ofBertin R. Chabot, Jr. (U.S. Pat. No. 4,945,866) recognizes and documents the benefits of an engine which has an offset between the axis of rotation of the crankshaft and the centerline of the piston reciprocation. This proposal, however, makes no attempt to eliminate the higher thrust which acts upon the piston as a consequence of the offset and resulting higher maximum connecting rod angle. This engine uses a conventional single-rotating crankshaft and connecting rod and thereby eliminates the possibility to obtain the advantages available with two counter-rotating crankshafts.

U.S. Pat. No. 2,362,838 issued to M. Mallory on Nov. 14, 1944, entitled "Internal-Combustion Engine", discloses a single-crankshaft motor which employs a connecting rod with a displaced shaft having a straight lateral profile and one radius at the base of one side where the connecting rod joins the crankshaft journal. In this engine, the piston cylinder is offset and includes a central cylinder wall which is located directly above the axis of rotation of the crankshaft. The base of this central cylinder wall is cut away to permit passage of the connecting rods which are disposed on the crankshaft side-by-side, moving in separate parallel planes.

U.S. Pat. No. 4,791,787 issued to Paul et al, entitled "Regenerative Thermal Engine", discloses a twin crankshaft engine having two connecting rods affixed to a single piston. Because it utilizes conventional straight connecting rods, this motor must provide an extremely large bore for its piston stroke and therefore is highly impractical for high-speed operation because of the mass of the large piston.

The multi-connecting rod engine of Ian R. Hammerton ( U.S. Pat. No. 5,435,232) utilizes two phased-together, spaced-apart, counter-rotating crankshafts and two or more connecting rods which are connected to a single reciprocating piston. Construction of this machine with overlapped crankshafts is complex and costly, and cannot be made compact. In the case where this machine employs three or more connecting rods, either the piston must be made very large to accommodate the attachments of the connecting rods, or the spaced- apart connecting rod attachments to the piston must be displaced toward each other to fit in the available space. As a result, transverse thrust forces are developed at both ends of these connecting rods, and they must be made heavier to support bending loads in the lateral direction. Where this device employs only two connecting rods, the transverse spacing of these connecting rods will create a moment (torque) on the piston which acts around the centerline of the piston and cylinder and will tend to twist the piston in opposite senses as each stroke of the piston is completed. These conditions prevent efficient operation at very high speeds.

Prior mechanisms using counter-rotating, phased-together crankshafts do not provide a mechanism which incorporates special characteristics to provide specific advantages for two-wheeled vehicles. There is therefore a need in the art for a device which solves these problems and which provides an advantageous powerplant for a two-wheeled vehicle.

SUMMARY OF THE INVENTION

In order to meet the need in the art as explained above, the present invention has been devised. An improved crankshaft and connecting rod mechanism provides altered reciprocating motion of a piston attached to the connecting rods and is capable of very high speed operation.

The basic mechanism includes two, geared-together, counter-rotating crankshafts which are transversely aligned along parallel axes of rotation and symmetrically spaced apart. Two connecting rods are similarly aligned and have both ends on one side of the axis of linear reciprocation of a connected piston. The axis of reciprocation of the piston follows a centerline between the crankshafts in the plane of alignment of the two connecting rods. The connection of the pair of connecting rods to the cylinder-guided piston is made by individual wristpins which are also aligned in the plane of motion of the connecting rods and have axes which are parallel and spaced apart in a symmetrical manner.

The shafts of the two connecting rods are preferably displaced ("bent" in the lateral profile) toward the centerline. This bend in the connecting rod shafts may be of such a magnitude that the shafts overlap during a portion of their motion by nesting together male/female profiles on their inner side surfaces, and this allows further design freedom in the chosen geometry. The big ends of the two connecting rods may also be constructed so that they overlap by nesting. This allows the rotational centers of the two crankshafts to be moved closer together providing additional freedom of design geometry, as well as the possibility to construct an even more compact engine with crankshafts of lower mass.

A particularly significant embodiment of the displaced connecting rod design employs arced connecting rods. The connecting rods of this embodiment have an arced lateral profile. That is, the centerline of the lateral profile section of the connecting rod follows an arcuate path at all points throughout the length of its shaft. Arced connecting rods may be extremely useful if designed so that the connecting rod shafts flex during tension and compression during the reciprocating cycle of the piston. In this way, changes in the effective overall length of the rod may both increase the swept volume of the piston at high RPM's and also beneficially increase the compression ratio if employed in an internal combustion engine.

Furthermore, the cylinder as well as portions of the crankcase may include notches or relief cuts on opposite sides of the cylinder to provide clearance for the connecting rods, thus providing further freedom of design for an engine or for another reciprocating machine, such as a pump. These notches or relief cuts in the wall of the cylinder can provide for passage of the connecting rods while maintaining the ability of this cylinder to guide the piston.

Among its advantages, the present invention does not create horizontal thrust forces on the piston. Also, the mechanism is rigid because of the alignment of the moving elements with the forces created by its various motions or by work performed by the machine, and thus it can be constructed of lightweight elements that operate at very high speeds. Furthermore, the mechanism inherently provides excellent first-order dynamic balance of the moving components without the addition of auxiliary balance shafts. Geometry of the components and direction of rotation of the crankshafts may be chosen to provide piston motions for efficient operation at either high or low speeds and for various engine or pump cycles.

The invention has special application to motorcycles in general, and single-cylinder motorcycles in particular. Of great importance is the opportunity to construct a very narrow engine for a two-wheeled vehicle, since the crankshafts may be extremely narrow. In addition, four shaft ends of the two crankshafts are available for mounting gear drives and accessories which are part of all motorcycle powerplants. This further narrows the motorcycle engine. Moreover, this relative narrowness allows more freedom of placement of the engine in the frame of the motorcycle to prevent grounding when the vehicle leans to the side as it negotiates a curve. Another advantage for a motorcycle is that two crankshafts of nearly equal mass rotate in opposite directions and, thus, annul the gyroscopic effect present in a conventional motorcycle engine. Therefore, changes of direction of the vehicle will require less force and it will also be free from the adverse effects of variation of engine RPM.

In consideration of the foregoing discussion, it is the primary object of the present invention to provide improvements to existing counter-rotating crankshaft mechanisms and to allow greater freedom of design geometry.

It is another object of the present invention to provide a compact, lightweight, low vibration, efficient engine, with the capability of high speed operation, for application to two-wheeled vehicles in general and single-cylinder motorcycles in particular.

It is a further object of the present invention to provide an engine which may be mounted lower in the frame of a two-wheeled vehicle, especially a single-cylinder motorcycle.

Another related object of the present invention is to provide an engine which is free of gyroscopic effects so that a motorcycle can change direction with less applied force that also does not vary with the speed of the engine.

Other objects, advantages and novel features of the invention will become apparent from the following detailed description of the invention when considered in conjunction with the accompanying drawings.

BRIEF DESCRIPTION OF THE DRAWINGS

FIG. 4A shows a lateral side view comparison of the present invention where a bent connecting rod shaft permits the selection of a smaller bore dimension of the cylinder.

FIG. 4B shows a side view comparison of the present invention where the bent connecting rod permits a longer connecting rod.

DESCRIPTION OF THE PREFERRED EMBODIMENT

Figure 1A:
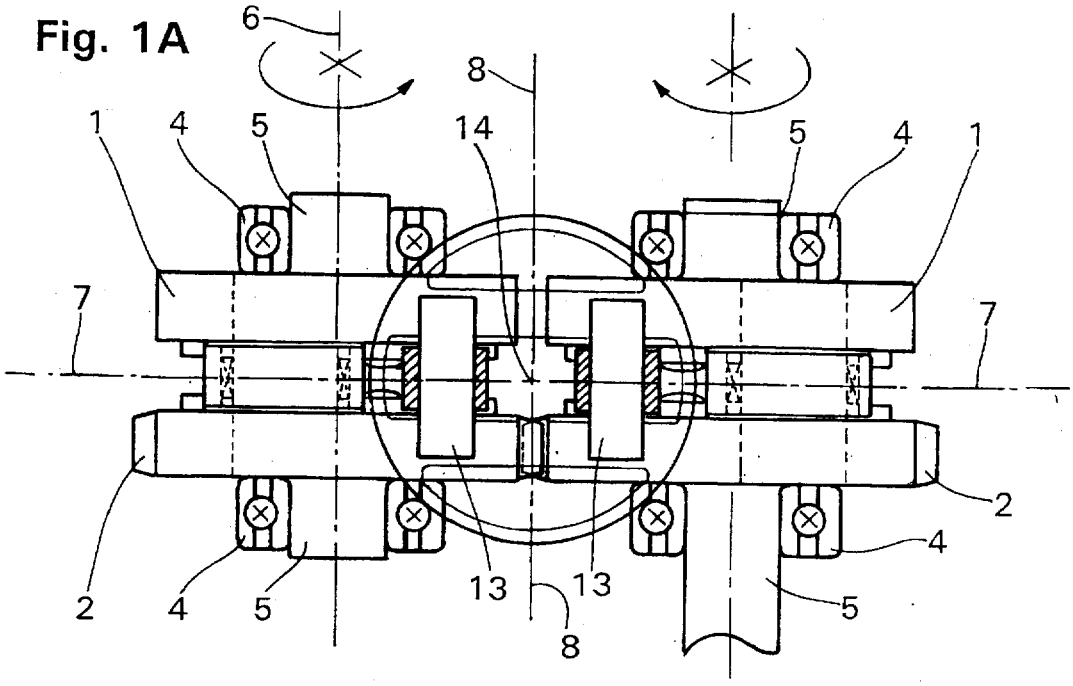
FIG. 1A shows a top view of the crankshaft mechanism of the present invention.
Figure 1B:
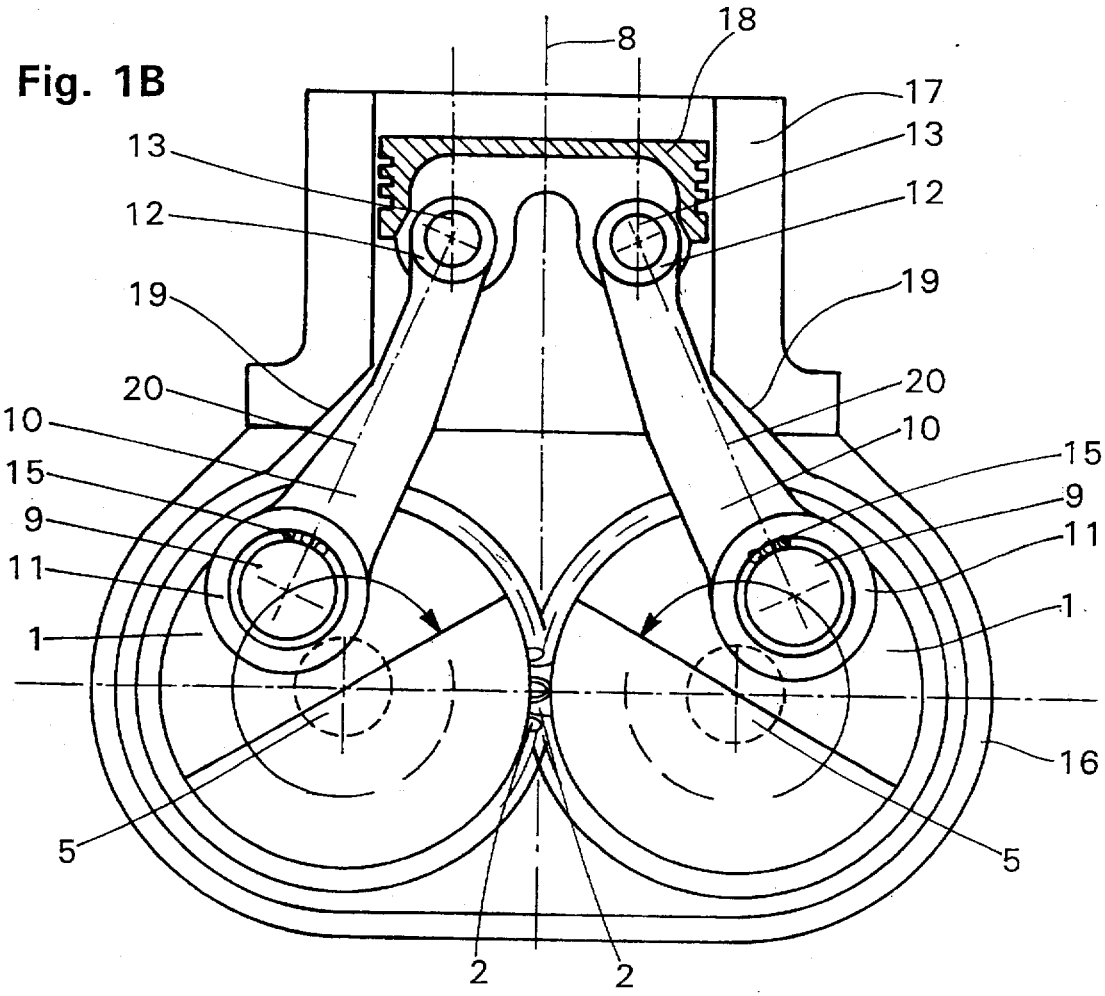
FIG. 1B shows a lateral view of the complete mechanism of the present invention. It also shows a proposed cross-section for a displaced connecting rod shaft.
Figure 2A:
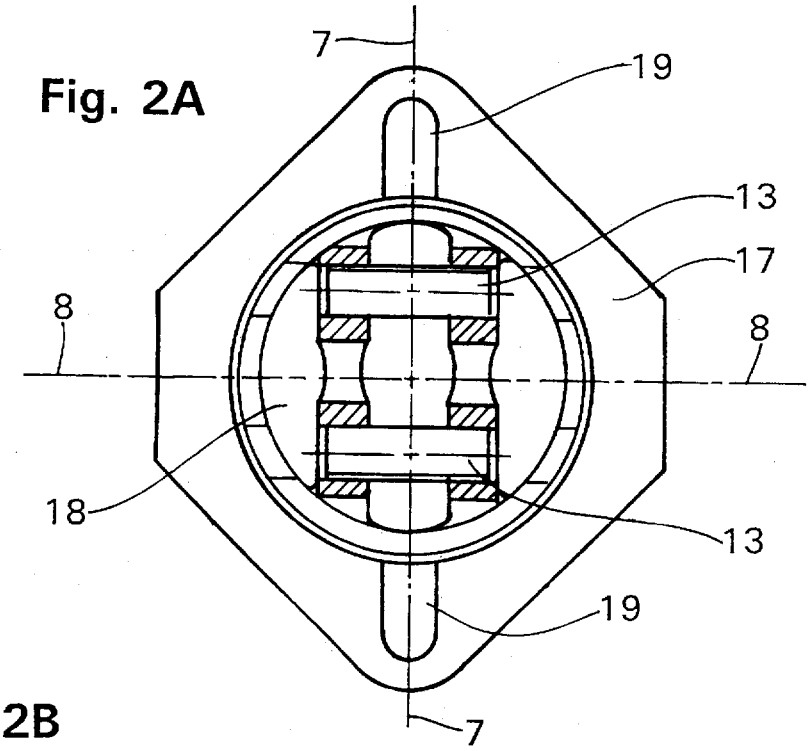
FIG. 2A shows a bottom view of a piston and cylinder with clearance notches which are part of the present invention.
Figure 2B:
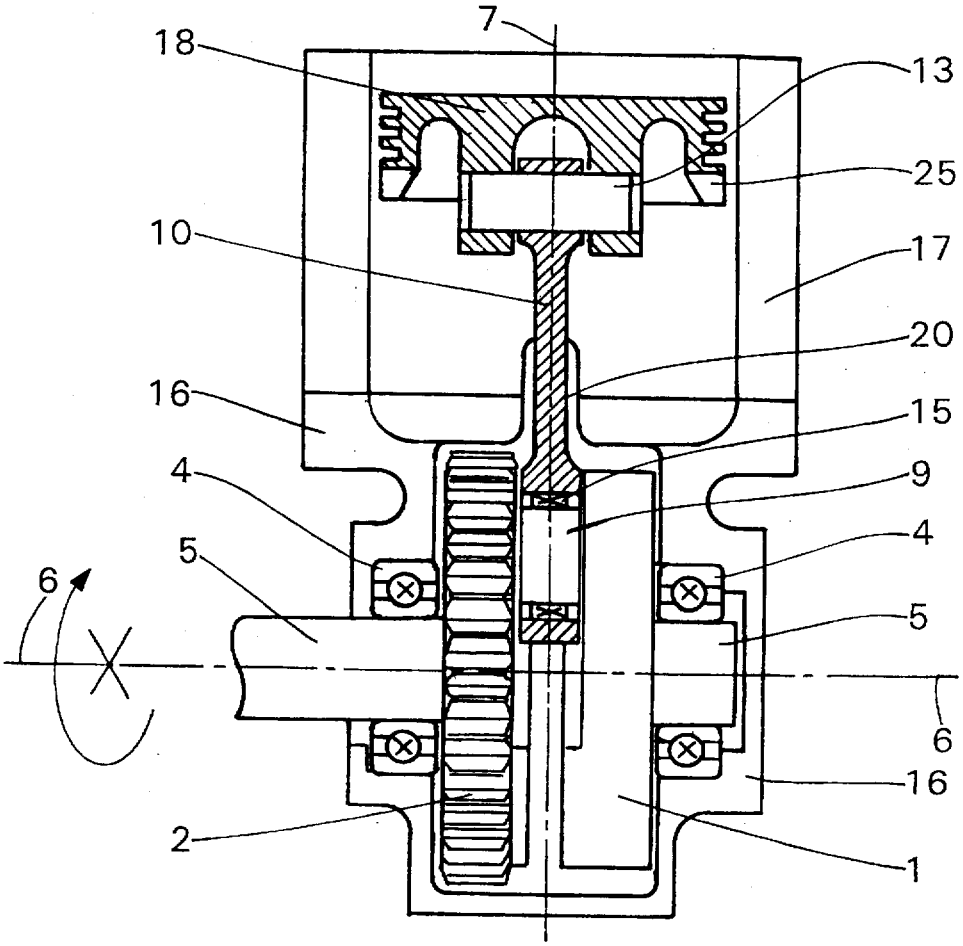
FIG. 2B shows a rear view of the present invention.

FIGS. 1A–B through 2A–B show an embodiment of the invention in which two crankshafts 1 are supported by bearings 4 and can thus rotate about their respective axes 6. The bearings 4 are fixed and oriented by the crankcase 16 which contains the crankshafts and provides an attachment of fixed position for a reciprocating guide, cylinder 17. The parallel crankshaft axes 6 are spaced apart and disposed symmetrically on either side of the transverse center plane 8 of the mechanism and are aligned transversely and to the longitudinal center plane 7 of the mechanism. That is, the midpoint of each crankpin 9 is in the longitudinal center plane 7. These two crankshafts 1 are phased together, in this particular case by gears 2 applied to the periphery of the respective crankshaft wheels on the same side of each crankshaft 1. The crankshafts 1 thus rotate in opposite senses and are in a constant phase. The gears may alternatively be applied to the shafts 5 in a location external to the crankcase 16 in order to achieve the same effect.

There are two connecting rods 10, each one having a big end 11 which is connected by way of a rotatable bearing 15 to a crankpin 9, and a small end 12 which is connected by a rotatable bearing to a wristpin 13. The parallel axes of the two wristpins 13 are spaced apart and disposed symmetrically on either side of the transverse center plane 8. These wristpins 13 are attached into a reciprocating piston 18 in such a way as to maintain their parallel spacing. The wristpins 13 are retained by suitable means in the transverse direction in such a way that they remain aligned in this same transverse direction. The reciprocating piston 18 is guided by cylinder 17. The path of the piston 18 shown in this figure follows a centerline 14 which is defined by the intersection of the longitudinal center plane 7 and the transverse center plane 8. This intersection forms the cylinder centerline 14 and axis of linear reciprocation.

Again referring to reference to FIGS. 1A–B and FIGS. 2A–B, it is shown that the a piston 18, has an abbreviated skirt 25 in comparison to the skirt of a conventional piston. This is possible because the connecting rods 10 have centerlines 20 disposed in a symmetrical manner on either side of the transverse center plane 8 and, thus, forces on the piston have longitudinal (horizontal) components which are equal and opposite to one another resulting in no net effect in this direction. The piston 18 with the brief skirt 25 will be lighter than a piston with a skirt of conventional dimensions. This allows the present engine to operate at higher speeds. In addition, the lack of side thrust of the piston 18 against the wall of the cylinder 17 will result in lower frictional losses, again adding to the capacity of the mechanism to operate at high speeds efficiently.

Still referring to FIGS. 1A–B and 2A–B, the connecting rods 10 are aligned in the longitudinal center plane 7 of the mechanism and are therefore aligned with the center points of the crankpins 9 and the crankshafts 1. Similarly, the axis of piston reciprocation 14 lies in the center plane of the mechanism. Therefore, all of the moving parts are centered on and are symmetrical to the longitudinal center plane 7 of the mechanism. Thus, the invention has all motion and all forces acting in a single plane. This alignment of the forces also permits operation at high rotational speeds.

In the preferred embodiment of the present invention, the big end 11 and the small end 12 of a connecting rod 10 are always on the same side of the transverse center plane 8. This arrangement finds advantage in comparison to an engine where the connecting rods cross over the center plane 8. This arrangement has two important advantages for high speed operation. First, as a result of the lesser maximum angle of the connecting rods 10, lower accelerations and associated forces are created. Second, the connecting rods will be shorter and of lower mass, again giving rise to lower forces.

An engine incorporating the present invention may be designed with a larger bore to stroke ratio than a conventional engine of the same displacement without sacrificing low speed torque. In a conventional four-stroke engine, a relatively large bore would result in an engine which develops less torque at low engine speed in comparison to a similar engine having a relatively smaller bore and larger stoke. With the present invention, more than 180 degrees of crankshaft rotation can be made available for the intake of the fresh charge of air and fuel as the piston moves from the top dead center (TDC) to the bottom dead center (BDC) position. Thus, more conservative intake valve opening and closing points are possible. With the choice of this more conservative intake valve timing, the engine will have the capacity to develop higher torque at relatively low engine revolutions.

Figure 3A:
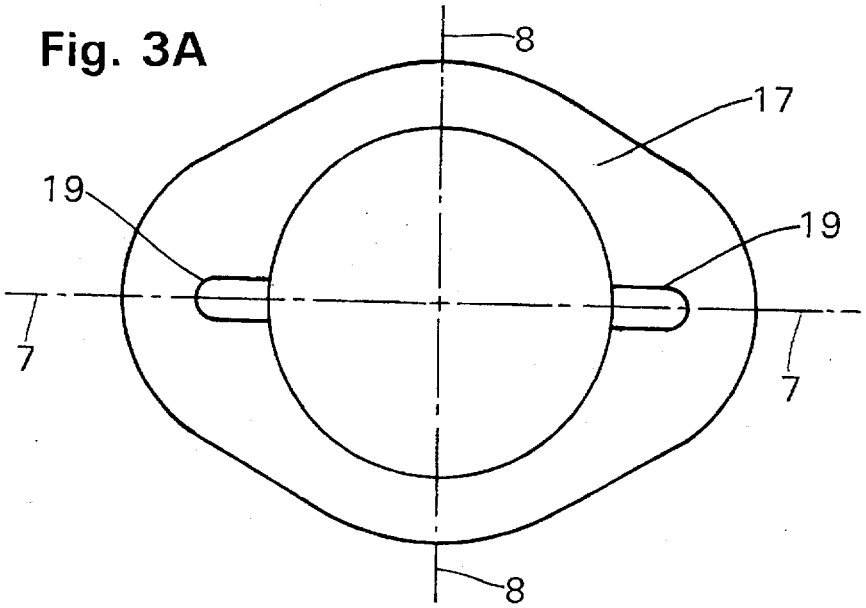
FIG. 3A shows a bottom view of the notched cylinder of the present invention.
Figure 3B:
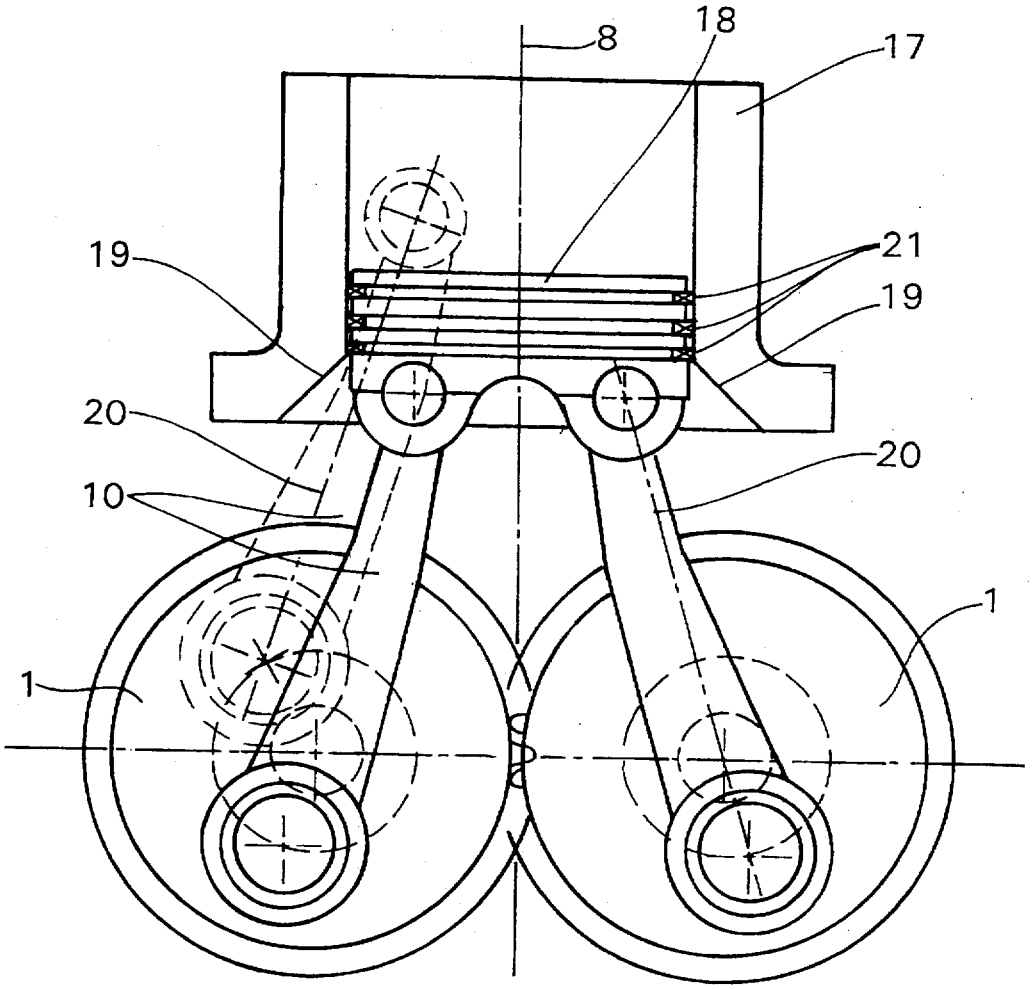
FIG. 3B shows a lateral side view of the present invention with notches and bent rod shafts in the position of maximum proximity to the cylinder.

Furthermore, the increased number of degrees of rotation equate directly to increased time for intake and so the cylinder volume can be better filled at high revolutions of the engine. Thus, a four-stroke engine can develop relatively high torque at both high and low engine revolutions. There is the further implication that engine efficiency will also be relatively high at both high and low engine revolutions, since piston engines in general demonstrate the best thermal and volumetric efficiencies at or near maximum torque. Referring now to FIGS. 3A–B, it is seen that in each revolution of the crankshaft 1 there is a position which brings the centerline 20 of connecting rods into maximum proximity to the wall of the cylinder 17. This condition is illustrated by the connecting rod 10 which is shown with a dashed line. In order to allow the connecting rod shafts to pass the wall of the cylinder 17 without touching it, two provisions are made.

First, clearance cuts 19 are provided to permit passage of the shafts of the connecting rod 10 into the bottom of the cylinder opening. These cuts 19 extend up into the cylinder 17 only so far that they do not impinge on the part of the wall of the cylinder 17 across which a ring 21 or other sealing element will traverse. This illustration shows the lowest position of the piston 18, at bottom dead center (BDC). Secondly, provision for the passage of the shafts of the connecting rods is made by the displacement (bending) toward the transverse center plane 8 of each connecting rod 10. This important condition results in the asymmetrical, bent-shaft profile of the connecting rods.

Referring to FIGS. 4A–B, the invention is shown in the position of maximum proximity of the centerline 20 of the connecting rods to the wall of the cylinder 17. In FIG. 4A, a connecting rod 10 is shown which has a conventional shaft that is symmetrical with respect to its own centerline 20, requiring the cylinder 17 to have a larger bore 21 than a connecting rod with a bent shaft. In FIG. 4B, the connecting rod 10 is shown having a bent shaft which permits a longer connecting rod length 22.

Figures 5A, 5B, 5C:
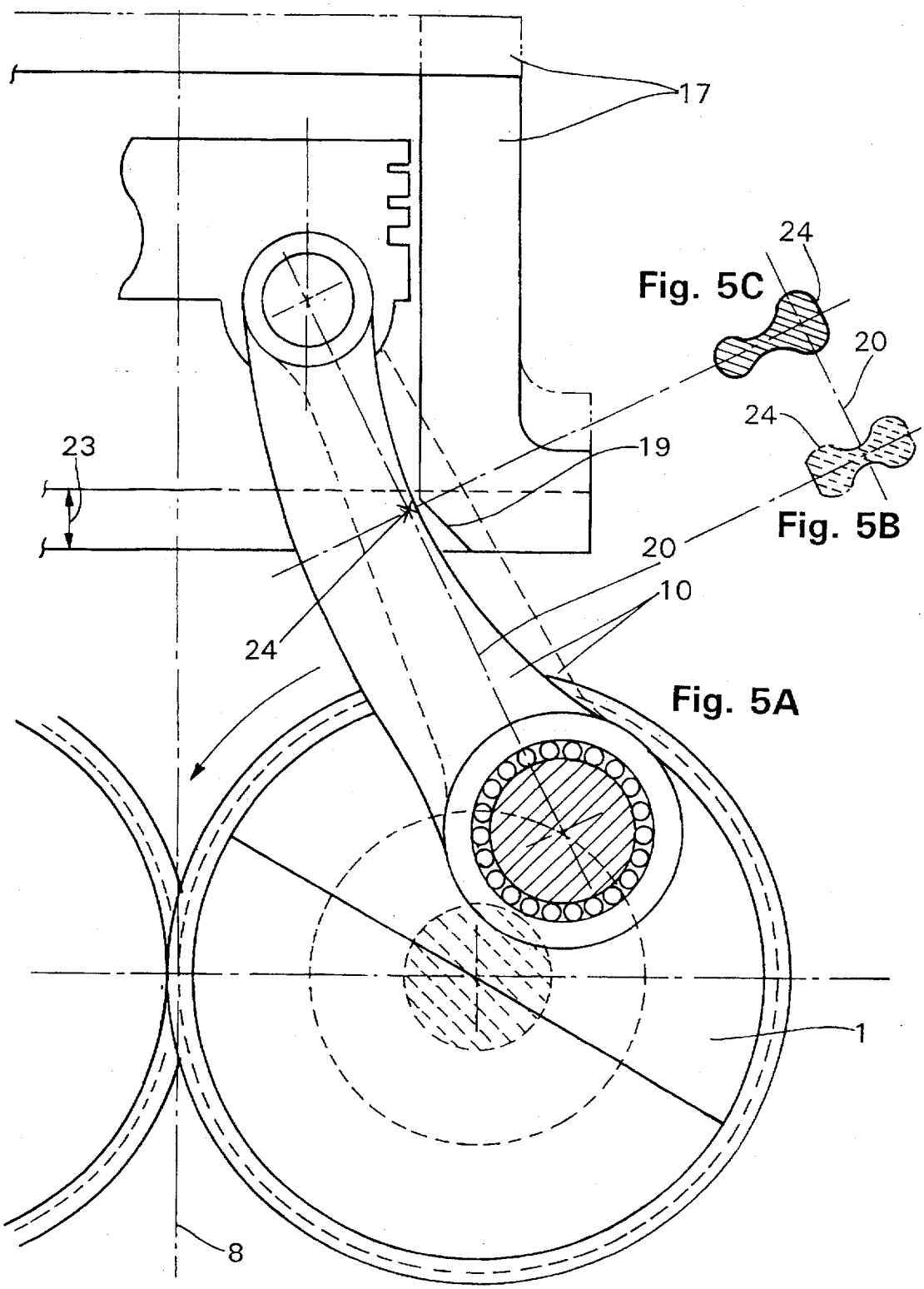
FIG. 5A shows a lateral view comparison of a bent connecting rod with that of a conventional connecting rod permitting a lower cylinder base position.
FIGS. 5B and 5C show comparison of a cross-section for a bent connecting rod (A) with that of a conventional connecting rod (B).

With reference to FIG. 5A, one-half of the mechanism is shown in the position of maximum proximity of the centerline 20 of the connecting rod 10 to wall of the cylinder 17. In this case, it can be seen that the connecting rod 10 having a bent shaft allows both the cylinder 17 and the clearance cuts 19 to be positioned closer to the crankshafts 1 than would otherwise be possible with a conventional straight connecting rod. The difference in position is indicated by vertical distance 23. It can be seen that it would also be possible to position the axis of the wristpin 13 farther from the transverse center plane 8 of the mechanism by incorporating the connecting rod 10 with a bent shaft.

Referring now to FIGS. 5B–C, cross-sections of the connecting rod 10 shafts at the point 24 of maximum proximity to the wall of the cylinder 17 are shown. FIG. 5B shows the symmetrical cross-section of a conventional connecting rod 10 at the point 24 of maximum proximity. FIG. 5C shows a proposed section for the connecting rod 10 with a bent shaft. The cross-section of this connecting rod is not symmetrical and is constructed with sufficient area concentrated around the centerline 20 of the connecting rod to support anticipated forces. This section also has sufficient length in the long axis of the section to support the anticipated bending loads which act on the shaft of the connecting rod as a result of inertial forces generated by its angular motion.

Figure 6:
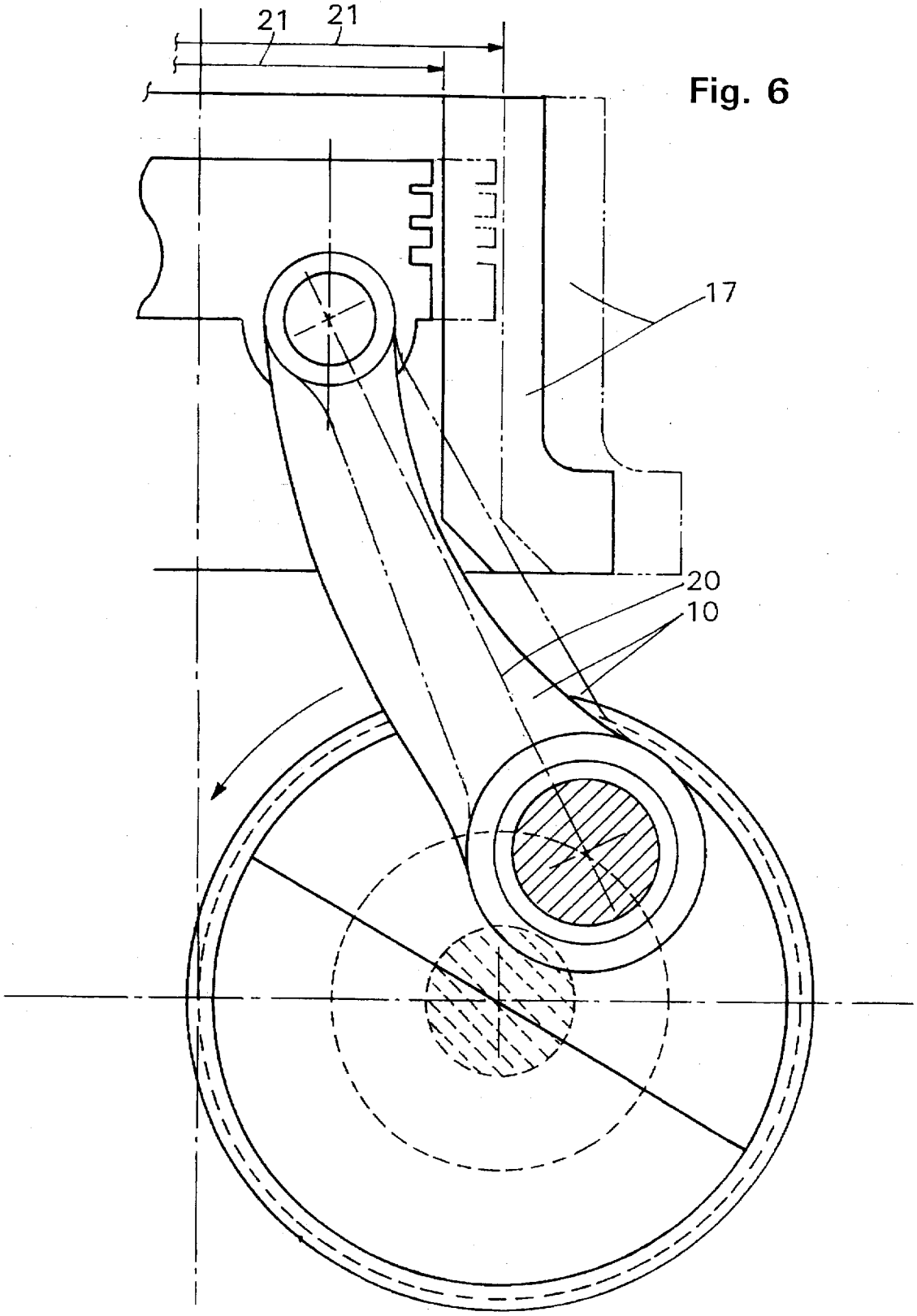
FIG. 6 shows a lateral view comparison of a connecting rod which is bent in an arc compared to a conventional connecting rod.

In FIG. 6, an alternative form of a connecting rod 10 with an arced shaft is shown. In this illustration, a conventional connecting rod 10 (indicated with a dashed line) is shown in comparison with a connecting rod having a displaced shaft in the lateral profile. This arced form is shown to provide similar advantageous passage of the connecting rod, as does the connecting rod of angular bent lateral profile presented in FIG. 5. Having an arced rather than an angular bent form, however, the shaft will have a more even distribution of stresses along the shaft and thus be better adapted structurally for certain applications, in particular, high-speed operation where fatigue strength of the connecting rod shaft is of great importance.

Still referring to FIG. 6, a further advantage of the arced connection rod 10 form is illustrated. As the connecting rod is subjected to inertial forces of tension and compression at the top and bottom of the piston stroke respectively, the arced shaft will flex in response to these forces. The arc of the shaft opens and closes during flexure and therefore the distance between the big and small ends of the connecting rod will change. In consequence, the piston will travel farther up at the top of its stroke and farther down at the bottom of its stroke than the static geometry of a rigid connecting rod. Thus, as engine speed increases, the deformation of the arced connecting rods will increase and so will the stroke and effective volumetric displacement of a pump or engine. An arced connecting rod which is carefully designed and constructed of an appropriate material can cause a small but useful increase of engine displacement. This effect will become larger as engine speed increases and thereby partially compensate for the reduced volumetric efficiency of an engine at high speeds.

The arced connecting rods may be made from a variety of materials, but are preferably selected from the group composed of tempered steel, high-grade spring steel, titanium or composite materials of complex construction. Composites are particularly well-suited to a connecting rod which flexes because of their extremely light weight and ability to flex and rebound at very high frequencies.

In a similar manner, an arced connecting rod will increase the compression ratio of the engine as engine speed increases, further compensating for the loss of volumetric efficiency. The compression ratio is not directly proportional to the connecting rod length increase. The ratio increases rapidly With the additional upward piston movement at the top of the stroke. This effect may be even more significant than the increase of displacement in augmenting the high speed power and efficiency. The compression ratio will increase over the static value by useful amounts.

Figure 7A:
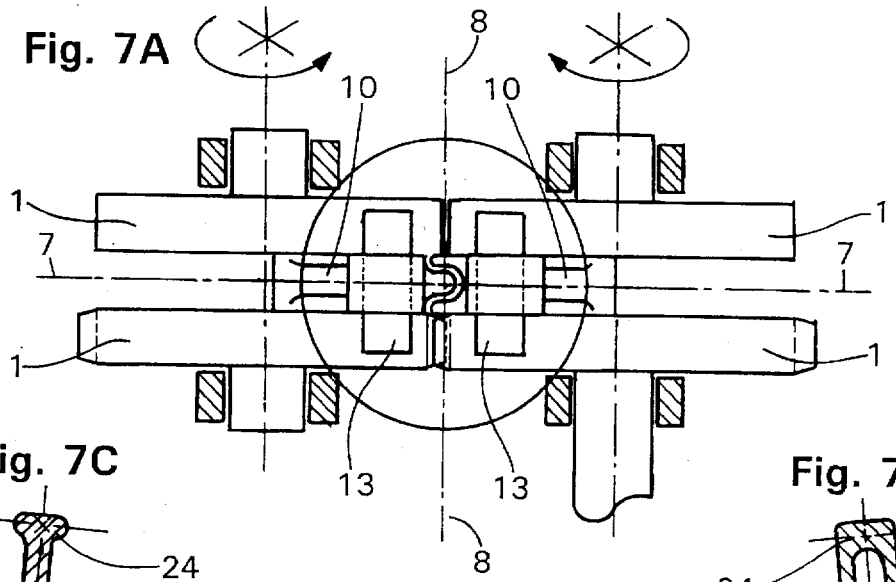
FIG. 7A shows a top view of the present invention where the connecting rods have been bent to pass the midline of the mechanism and fit within one another.
Figure 7C:
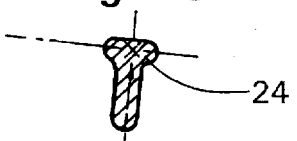
FIG. 7B shows a lateral view of the present invention with nesting connecting rods with a bent profile as in FIG. 7A. Auxiliary views show the form of the two different connecting rods and cross-sections of their respective shafts.
Figure 7D:
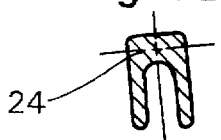
Figure 7B:
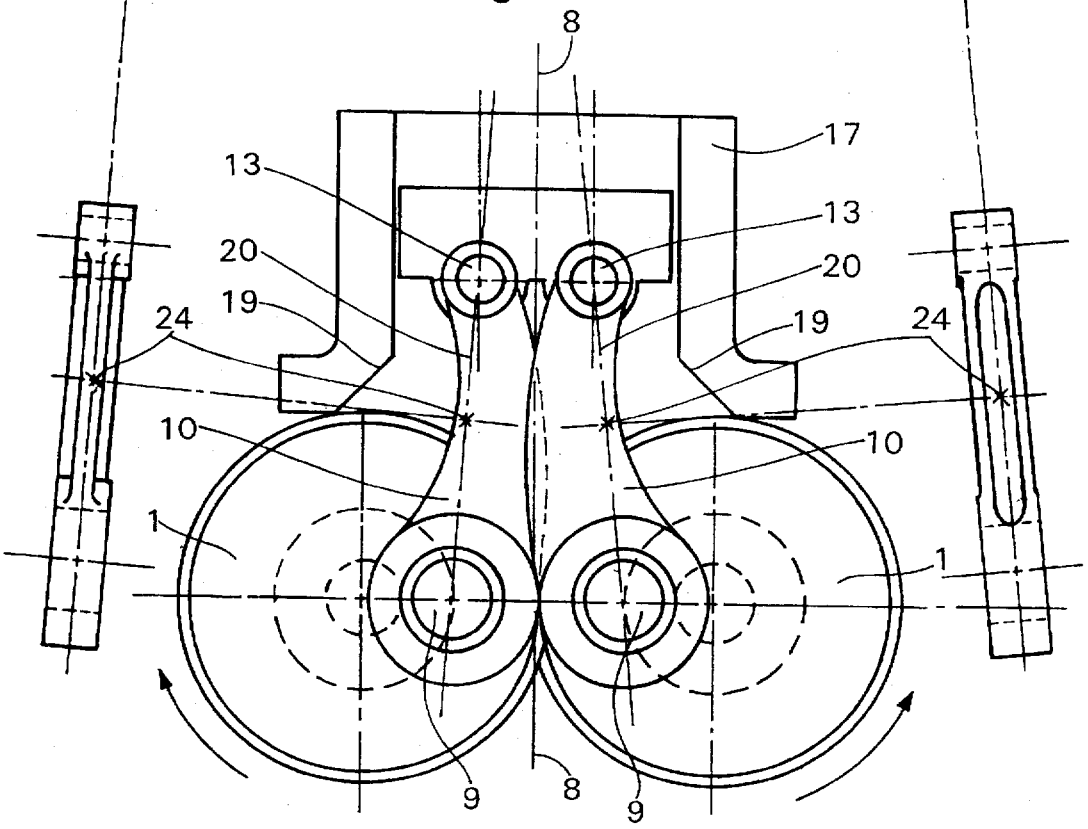
Figure 8A:
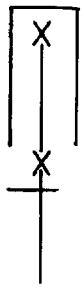
FIGS. 8A through 8I show various configurations of compatible connecting rod cross-sections which overlap.
Figure 8B:
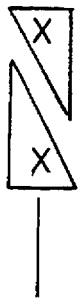
Figure 8C:
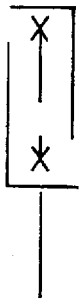
Figure 8D:
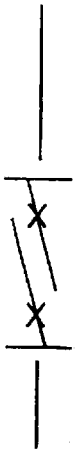
Figure 8E:
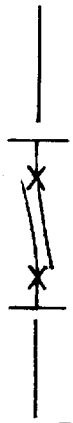
Figure 8F:
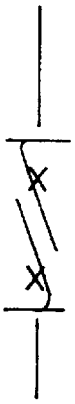
Figure 8G:
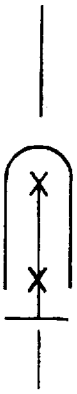
Figure 8H:
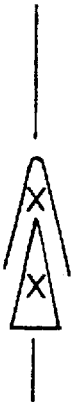
Figure 8I:
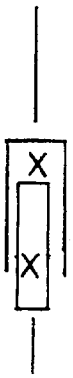

FIGS. 7A–7B show views of the same basic mechanism with the crankpins 9 in the position of maximum proximity of the connecting rods 10. These illustrations show that additional freedom of design geometry can be provided by designing the connecting rods to allow the fitting together, or "nesting" of their shafts, without touching.

In order to provide the possibility for nesting, the connecting rods 10 have shafts made with complimentary male and female forms. Auxiliary views 7C and 7D of each respective connecting rod 10 in maximum proximity to the wall of the cylinder 17 are shown. Also, nesting of the connecting rods will permit the wristpins 13 to be placed closer to the transverse center plane of the mechanism. Alternatively, the profile of the connecting rod 10 may be made wider at the point 24 of maximum proximity of the centerline 20 of the connecting rod to the wall of the cylinder 17. Being wider at point 24 provides efficient structural reinforcement of the shaft of the connecting rod and it is thus better able to bear the bending loads.

FIG. 8 shows a multiplicity of possible compatible connecting rod shaft configurations which overlap. Some of these configurations "nest". These are FIGS. 8A and 8G, H, and I. The others illustrate connecting rods which overlap, side-to-side.

Figure 9:
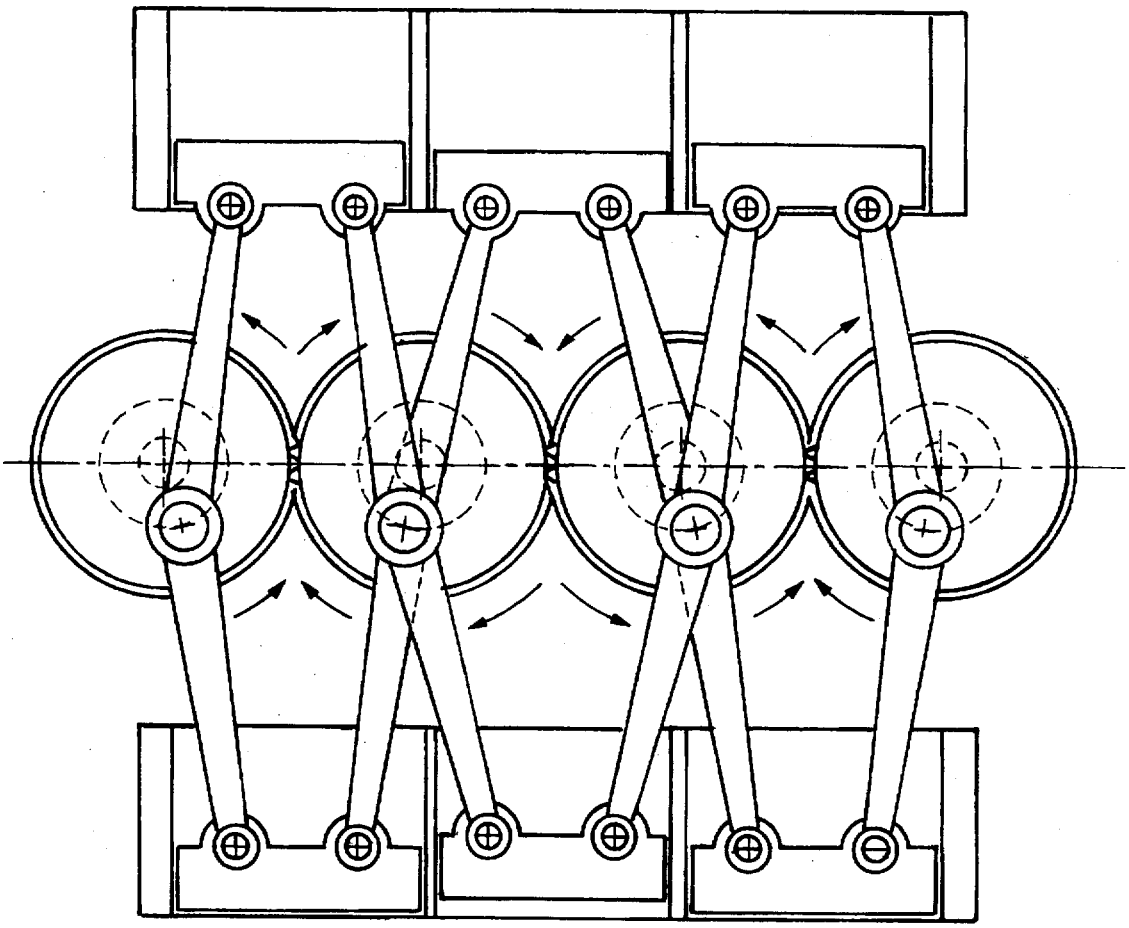
FIG. 9 is a side-sectional view of an embodiment of the present invention employing multiple opposed cylinders.
Figure 10:
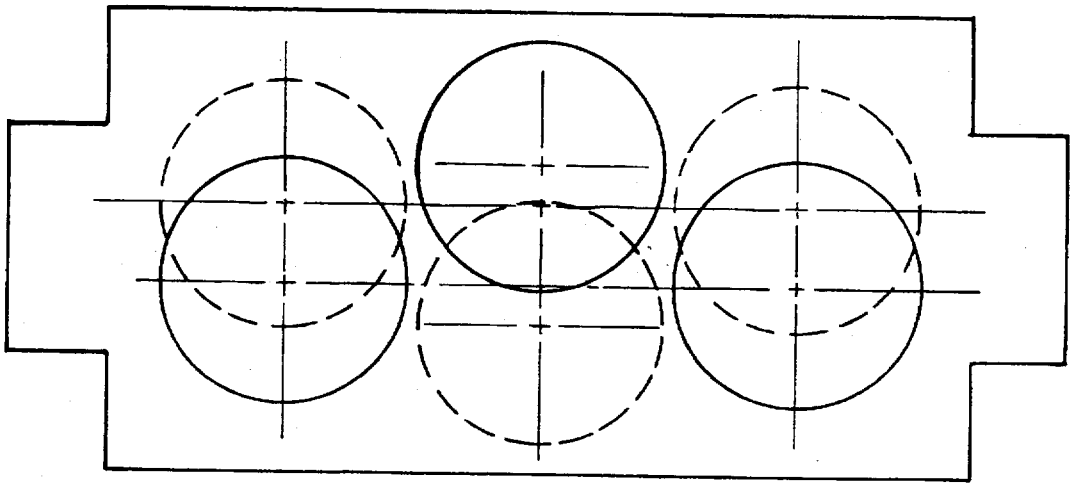
FIG. 10 is a diagrammatic representation of the side view of the multi-cylinder mechanism shown in FIG. 9.

FIGS. 9 and 10 show views of an arrangement which employs the present invention as applied to a multi-cylinder configuration. In these figures, a six-cylinder device is shown which employs four geared-together parallel crankshafts. As more clearly shown in FIG. 10, the opposing cylinders are offset slightly because the connecting rods for opposing pistons are arranged side-by-side, operating in separate planes of motion.

Figure 11:
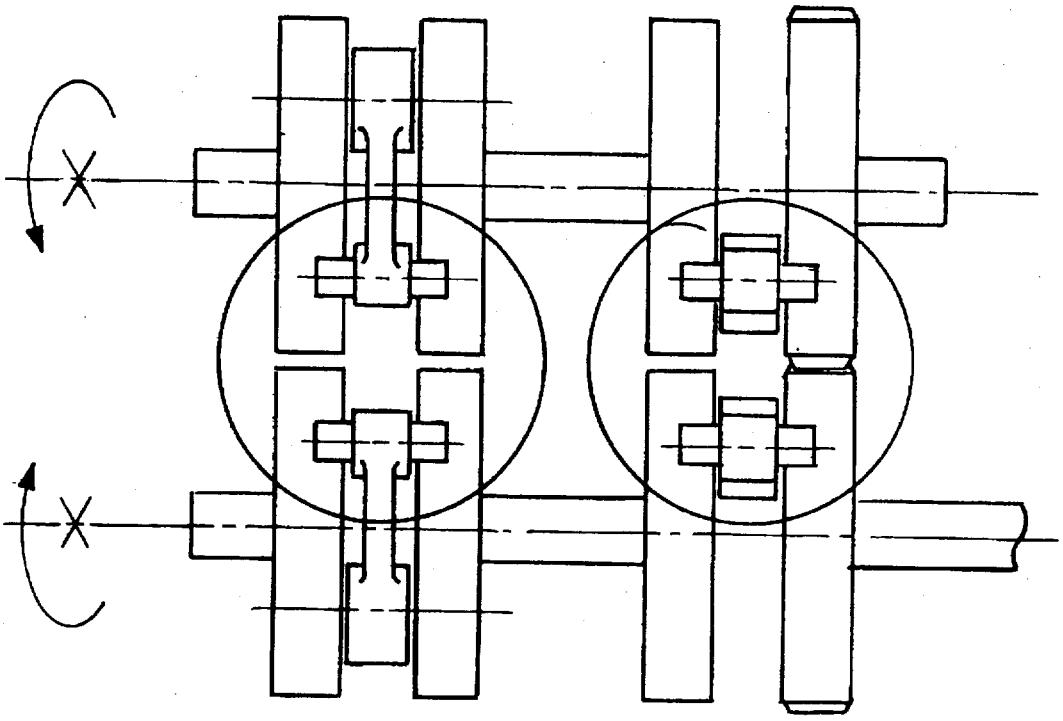
FIG. 11 is a top plan view of a twin-parallel cylinder embodiment of the present invention.
Figure 12:
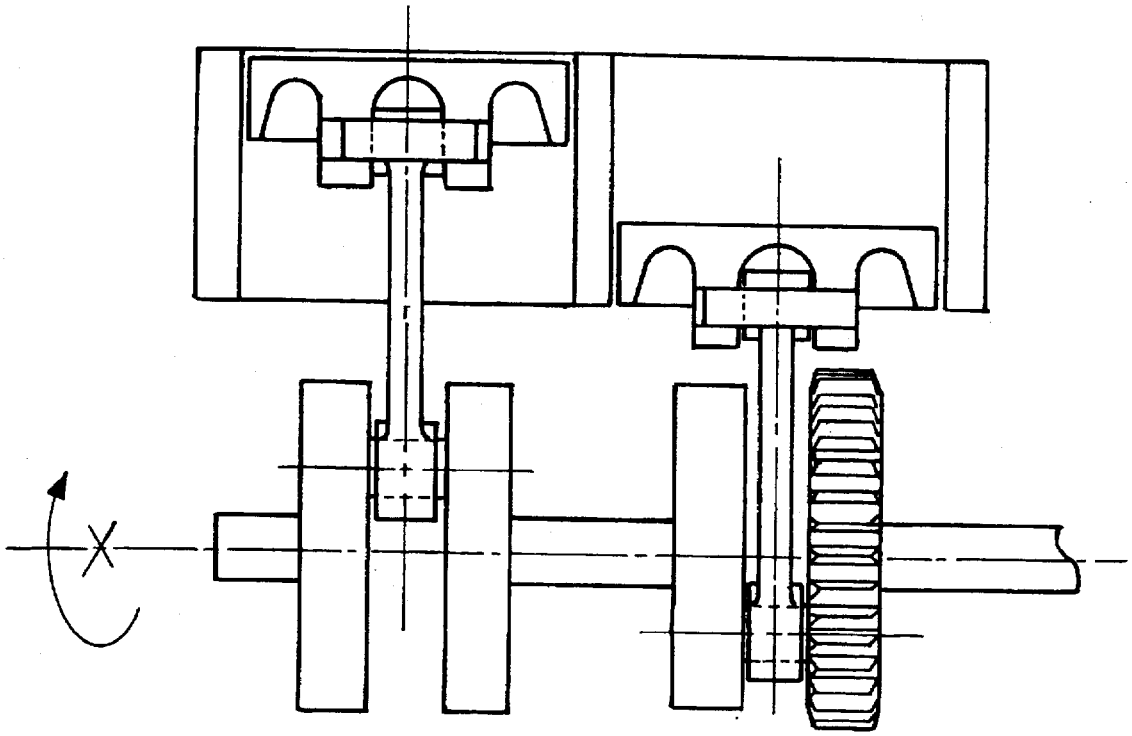
FIG. 12 is a front elevational view of the twin-cylinder embodiment shown in FIG. 11.

Referring to FIGS. 11 and 12, an alternate embodiment of the present invention is shown having twin cylinders side-by-side sharing the same parallel crankshafts. It will be readily understood by those of skill in the art that likewise additional cylinders may be added by further extending the crankshaft and adding additional cranks and connecting rods for successive parallel cylinders that are added.

Figure 13A:
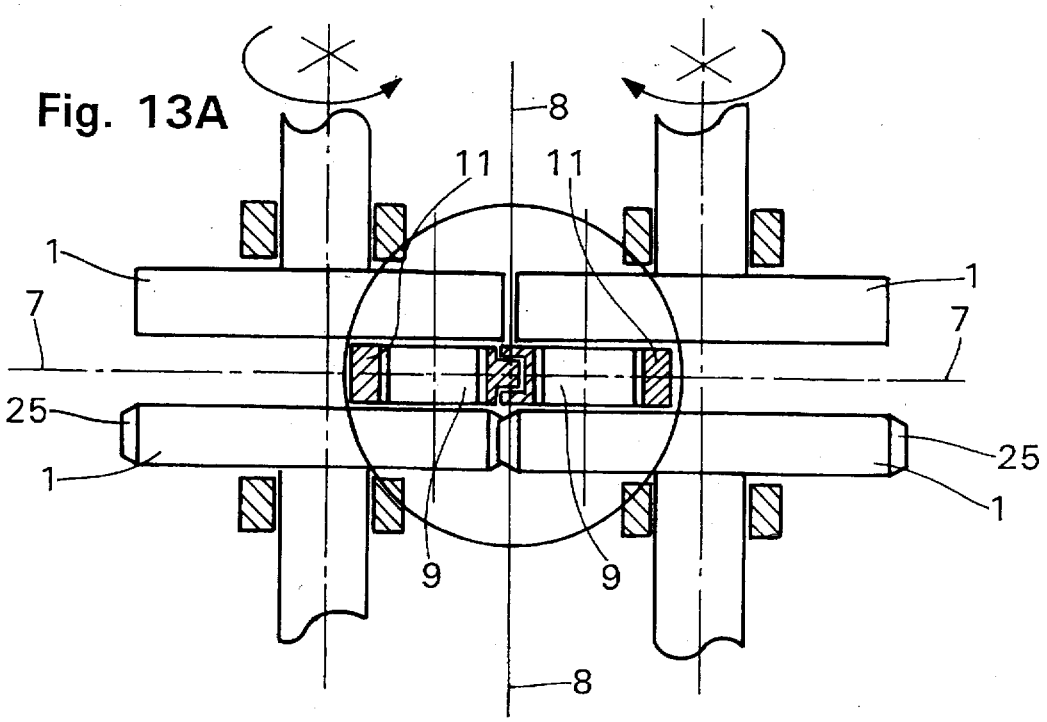
FIGS. 13A and 13B show top and side views of the present invention where two arced connecting rods are formed so that they fit together.
Figure 13B:
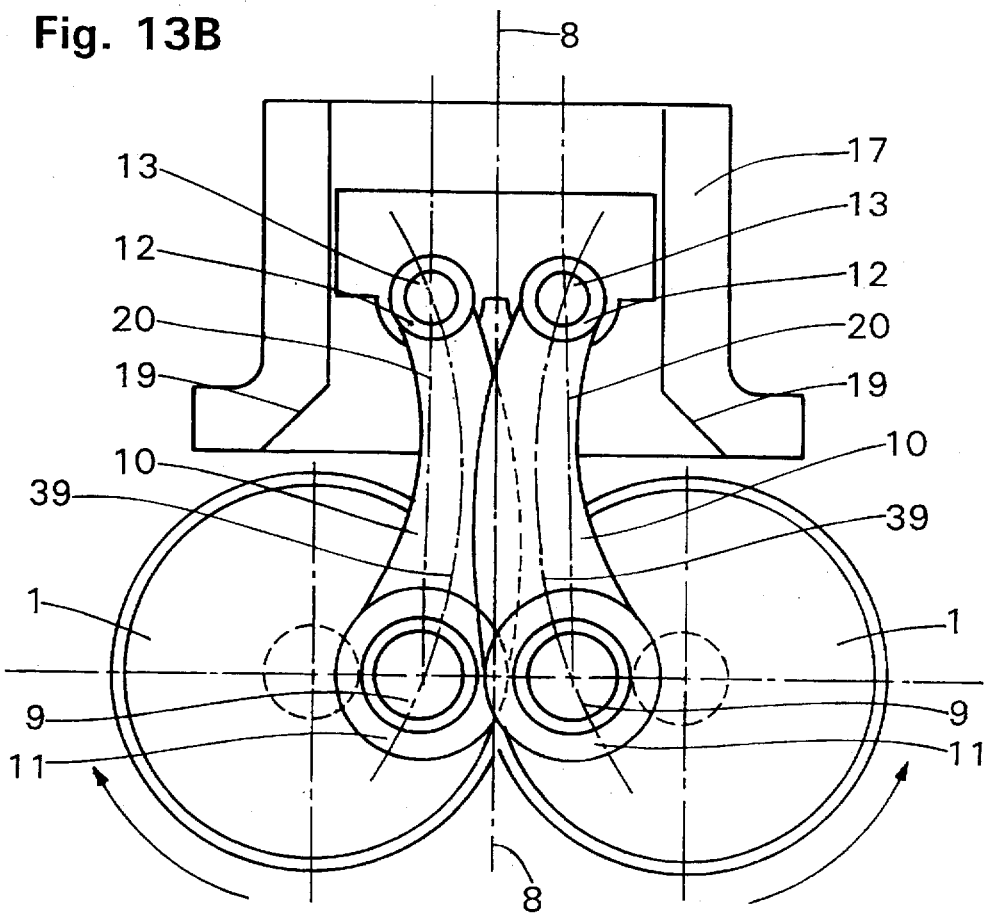

With reference to FIGS. 13A and 13B, it is seen that the previously described characteristic of nesting of the shafts of the connecting rods can be extended also to the big ends 11 of the connecting rods so that the structure of the big ends 11 can partially cross the transverse center plane 8. In this manner, it is possible to maintain adequate structural strength of the big ends of the connecting rods, while allowing a closer proximity of the crankpins 9. In this way, a longer stroke of an engine may be employed to create a larger volumetric displacement without increasing the dimensions or mass of the crankshaft. Greater detail of this arrangement is shown in FIG. 14.

Regarding FIG. 13, the connecting rods of this embodiment are arced, meaning that both the line formed by the centers of shaft cross-sections 39 and the lateral profiles of the connecting rods are always curved and never straight as they extend from the wristpin to the big end. Connecting rod centerlines 20 are straight lines between ends of the connecting rod and are shown to demonstrate the degree to which these arced rod shafts are displaced from that of a conventional straight connecting rod with a straight centerline. The use of these arced rods not only provides the advantages previously discussed with respect to bent connecting rods which include a larger deviation of the path of the cross-sectional centerline, but also provides some unique advantages. First, the arced form of these rods lends itself to a controllable and non-destructive increase of the connecting rod length at high RPM when the piston reaches top dead center. Similarly, the rod may deflect and shorten during compression at bottom dead center. Although this deflection may be slight, the bending is predictable, controllable, and non-destructive to the rod. This change in length in the connecting rod within each rotational cycle will increase the effective displacement of the piston at high RPM. As a further advantage, the compression ratio will also increase because the piston will extend farther up the cylinder at top dead center. The ability to have an increased compression ratio at higher RPM may be significant. The change in the swept volume of the piston due to connecting rod flexure at very high RPM may only be a few percentage points, however, this may also be a significant advantage where even slight increases in performance are sought, such as racing applications.

Figure 14:
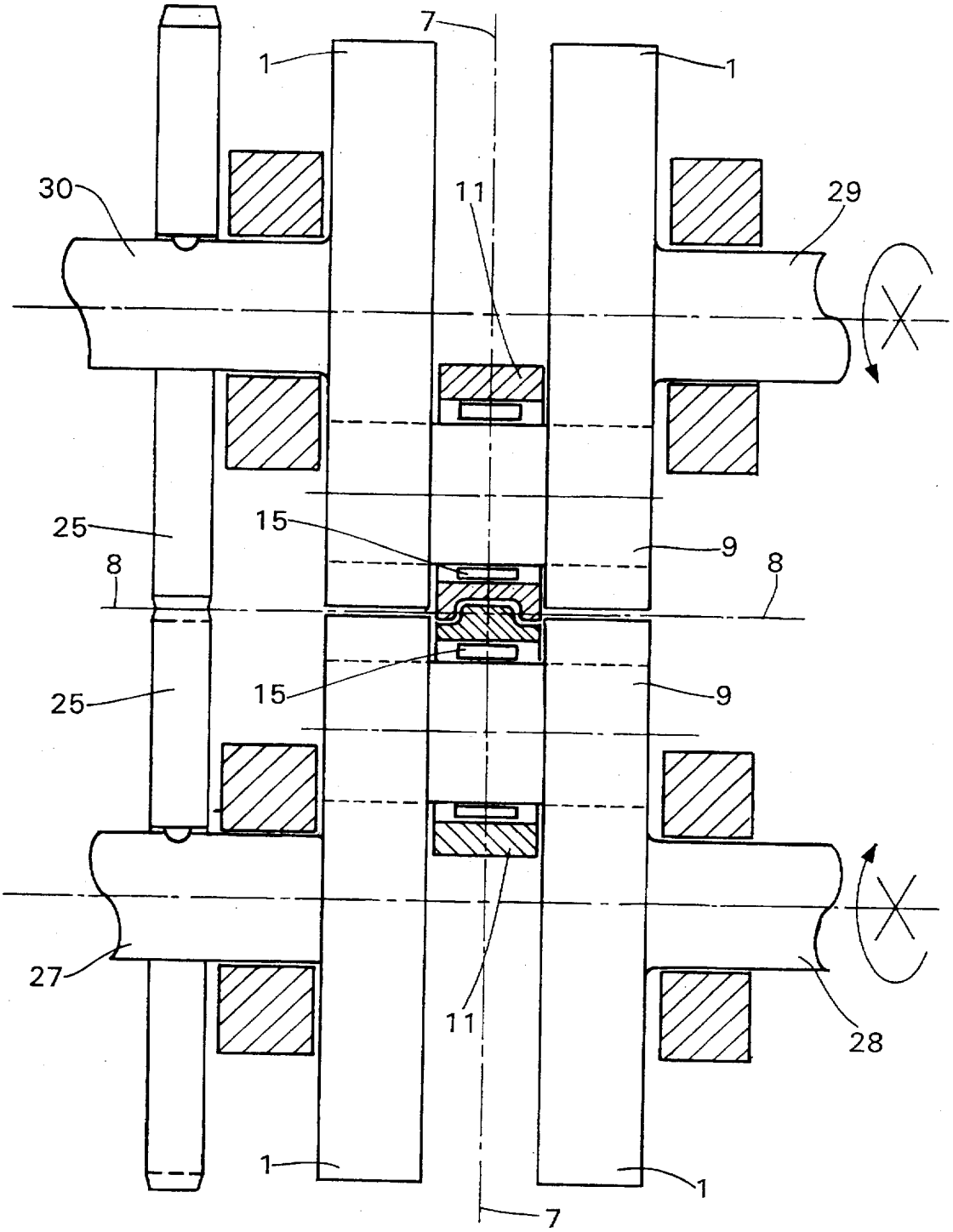
FIG. 14 is a top sectional view of the big ends of two connecting rods in which compatible male/female profiles nest together at their point of maximum proximity.

With reference to FIG. 14, the basic mechanism of the present invention, having two crankshafts 1, makes available four shaft ends 27, 28, 29, 30 which can be used for various purposes. For example, the four shaft ends will be available for mounting rotating accessories, couplings, gears, pulleys, sprockets, or other machine elements which can be used to drive not only the components required for the operation of an engine, but also other mechanisms, such as a generator, pump, or a vehicle which carries the engine.

Figure 15A:
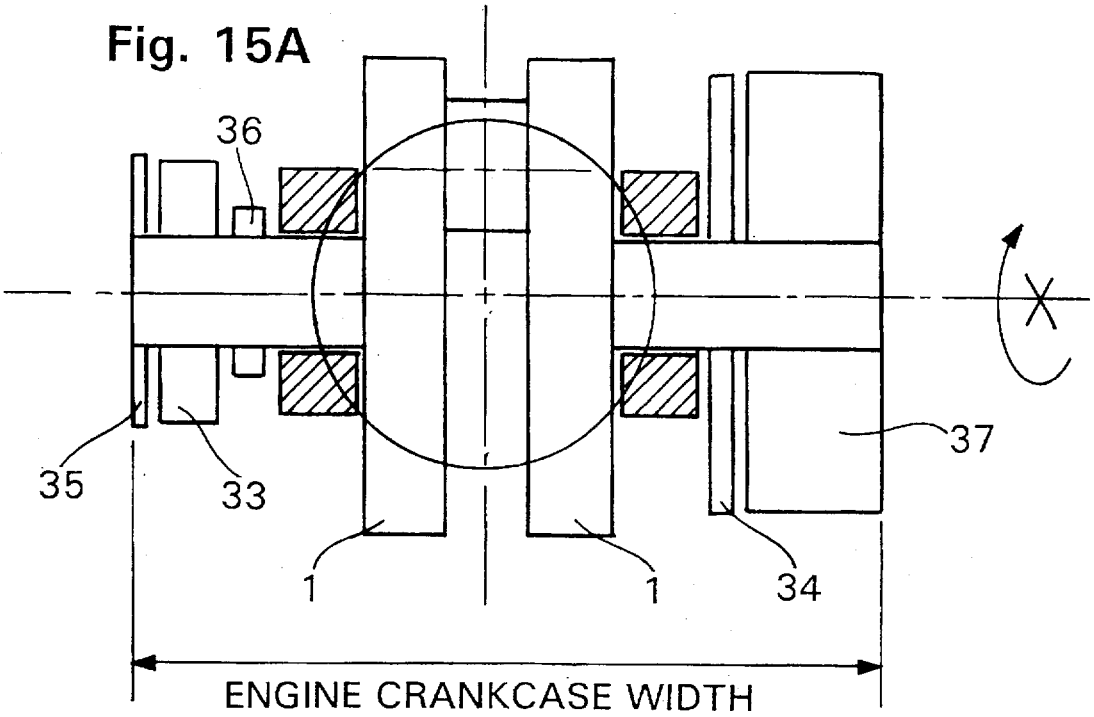
FIGS. 15A and 15B show a top view comparison between the crankcase width of a conventional engine crankshaft mechanism (FIG. 15A) and that of the crankshaft mechanism of the present invention (FIG. 15B).
Figure 15B:
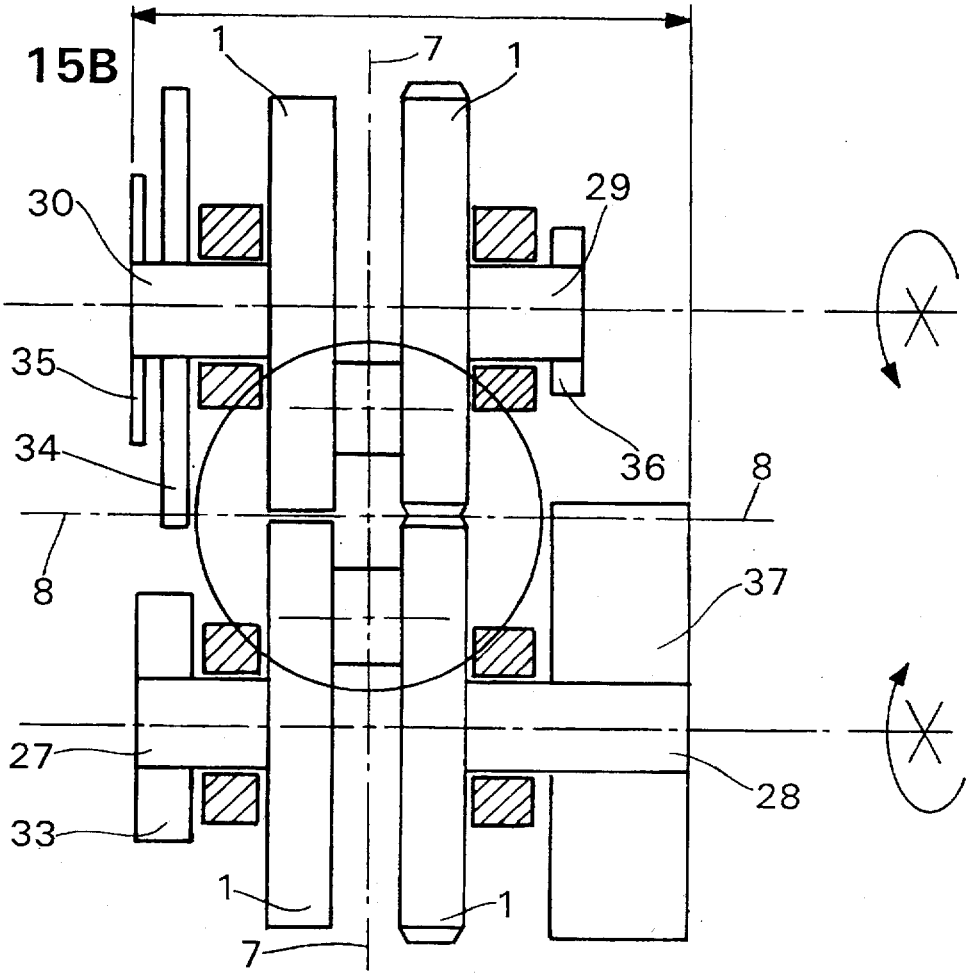

The availability of four shafts 27, 28, 29, 30 is a significant advantage of the present invention. With reference to FIGS. 15A and B, a comparison is shown between two different single-cylinder engine crankshaft assemblies which could be used to power a motorcycle. FIG. 15A shows the crankshaft assembly of a conventional single-cylinder engine having one crankshaft 1. FIG. 15B shows the crankshaft assembly of a single-cylinder engine which incorporates the two crankshafts 1 of the present invention. The engines are assumed to be of approximately the same displacement. The crankshafts 1 and its support bearings are illustrated in dimensional proportion which shows that having dynamic loads shared by two crankshafts permits the support to bearings be smaller. On the crankshaft(s) of each crankshaft assembly are mounted elements and accessories which are necessary to operate the engine and to drive the motorcycle. The mounted elements and accessories of this particular example are: vehicle drive pinion 33, electric starter drive gear 34, ignition or fuel injection trigger wheel 35, oil pump and/or camshaft drive pinion 36 and alternator rotor 37. It is clear that the invention presented in 17B allows a more narrow crankcase. For certain motorcycles where high performance is desirable, the very narrow aligned crankshafts of this mechanism permit an advantageous lower placement of the engine. The possibility of a compact height for an engine can further lower center of gravity of the motorcycle. An additional benefit for a motorcycle is that the paired, counter-rotating crankshafts cancel the gyroscopic effect of each other and thus change of direction of the vehicle is made easier.

Figure 16:
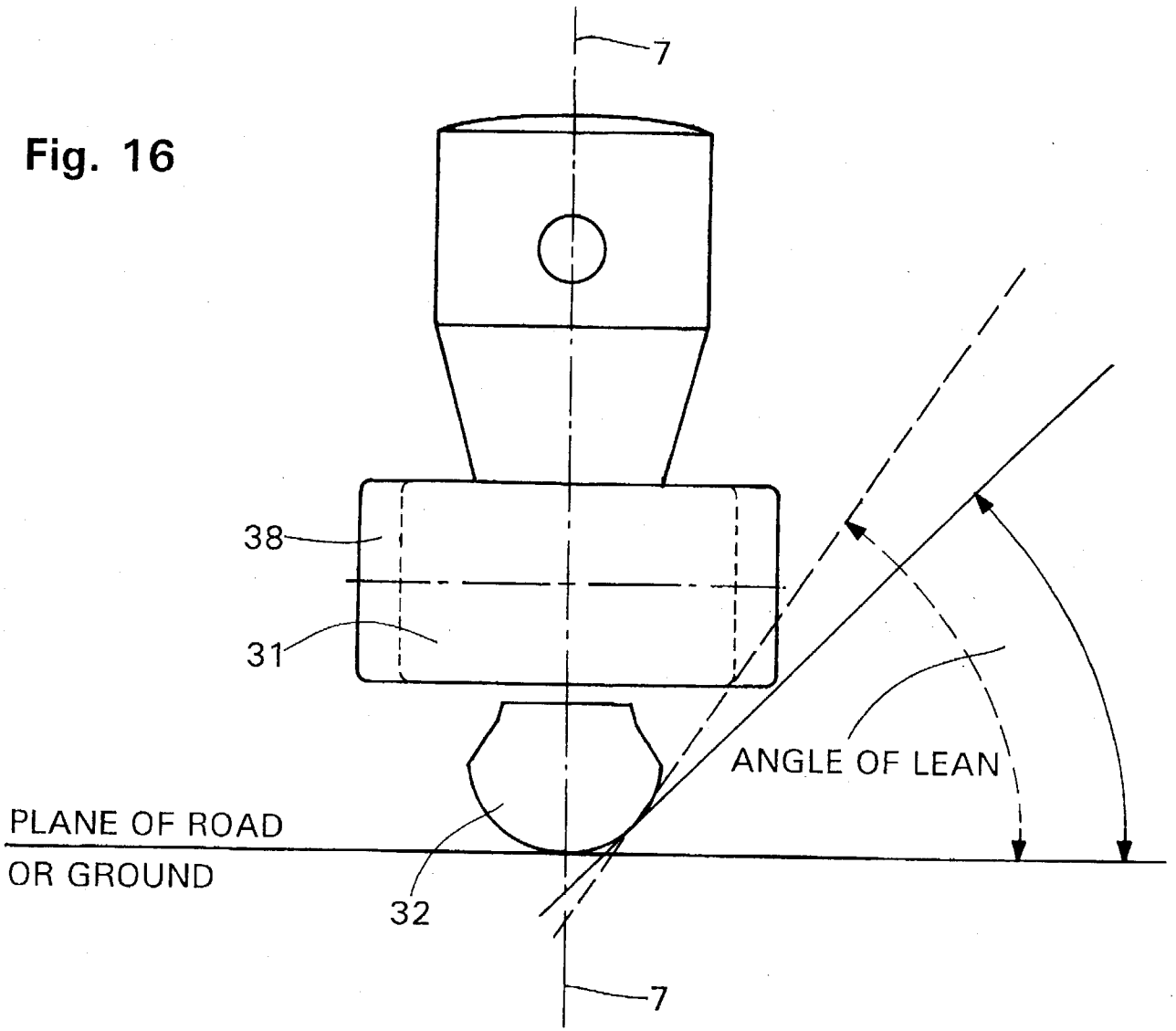
FIG. 16 shows schematic front view partial silhouettes of a single-cylinder motorcycle engine and the rear tire of the motorcycle in the relation to one another found when the motorcycle negotiates a curve and the suspension of the motorcycle is partially compressed.

With reference to FIG. 16, other important advantages of the present invention applied to motorcycles can be seen. Shown are the frontal silhouettes of a single-cylinder motorcycle engine and rear tire 32 of the motorcycle when negotiating a curve with its suspension partially compressed. Motorcycles must lean toward the road surface when turning a corner or rounding a curve. In this illustration, a maximum angle of lean just before the crankcase of the motorcycle comes into contact with the plane of the road or ground is indicated. A comparison is drawn between the maximum angle of lean possible for a motorcycle having an engine with a relatively wide crankcase 38 and that angle which is possible for a motorcycle having a relatively narrow crankcase 31.

Thus, it can be seen that the angle of lean for the motorcycle can be greater if it has a relatively narrow crankcase 31. The ability of a motorcycle to lean farther on changing direction provides the possibility of increased maneuverability. Alternatively, if a constant maximum angle of lean is to be preserved, a motorcycle can have the engine mounted lower relative to the plane of the ground or road. This can be of great advantage for motorcycles intended for high speed maneuverability because the center of gravity of the vehicle is made lower.

Figure 17:
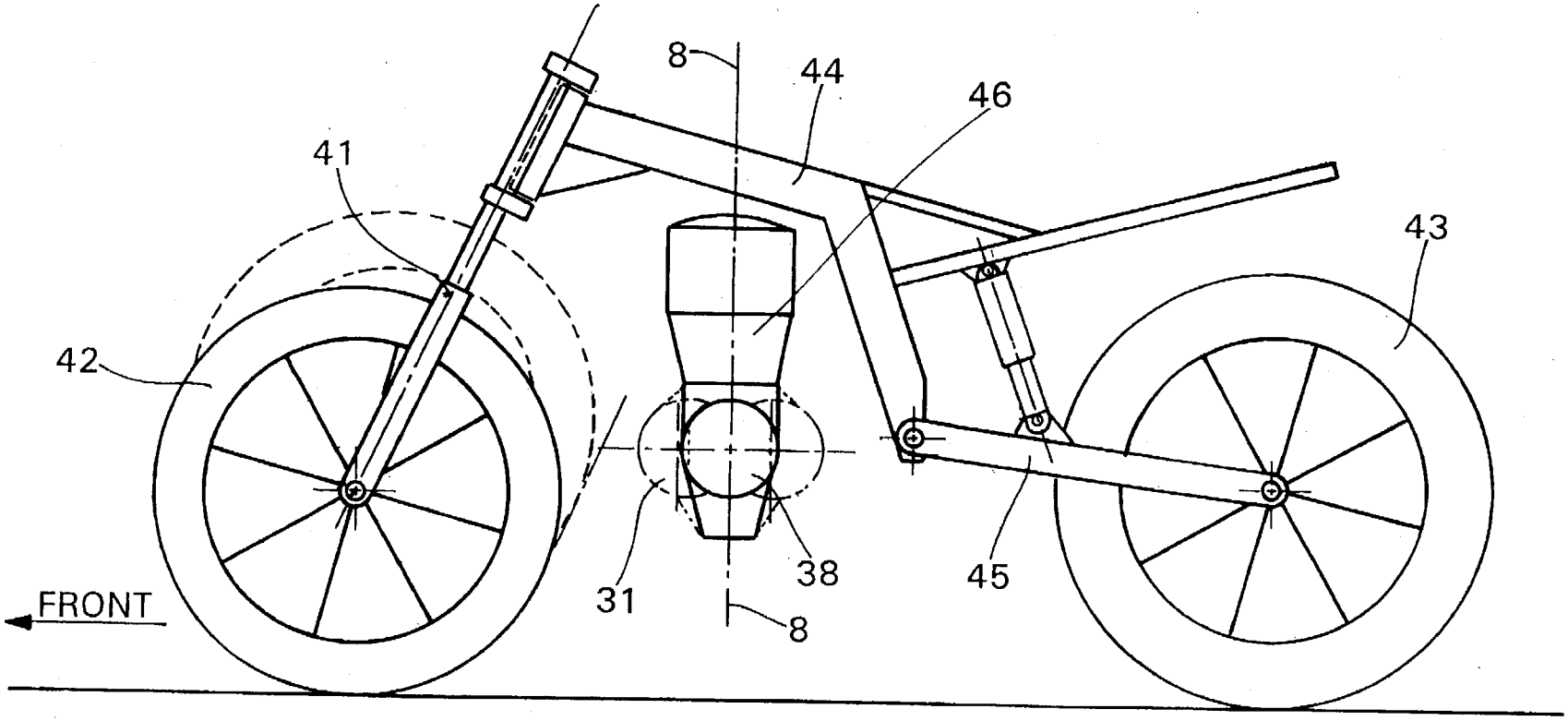
FIG. 17 shows the side view of a single-cylinder or transverse multi-cylinder engine in a motorcycle. The projection of the crankcase mechanism of the present invention is shown to project into a space which is otherwise used.

In FIG. 17 a motorcycle chassis and engine is illustrated. The motorcycle includes a frame 44 which carries a steerable front wheel 42 which is held and guided by front fork 41. Engine 46 is mounted substantially vertical in the frame. Rear swing arm 45 is also mounted to the frame 44 and carries rear wheel 43. The potential movement of the front wheel and tire is indicated, showing the front tire as a dashed line in the case when the front suspension of the motorcycle is fully compressed. The motion of the front wheel and tire defines the anterior limit of a certain space in front of the engine, and is indicated by a dashed line which follows the path of the tire parallel to front suspension of the motorcycle. The engine of this motorcycle is shown with the crankcase 38 of a conventional engine having one crankshaft 1 as described and illustrated in FIG. 15A. This crankcase 38 is indicated by a solid circle. Imposed upon this and centered on the same cylinder centerline, which lies in the transverse mid plane 8, is the crankcase 31 enclosing two the crankshafts 1 of the present invention as illustrated in FIG. 17B. This crankcase 31 is indicated by two dashed partial circles which are joined. The purpose of this illustration is to demonstrate that the additional crankshaft of the present invention which projects forward into a space is commonly unused in a motorcycle having a conventional engine. Thus, the motorcycle does not need to be longer and disadvantaged by having a longer wheelbase.

In summary, the application of the present invention to the engines of motorcycles in general, and to single-cylinder engines for motorcycles in particular, can provide the possibility to construct a motorcycle which has a compact, lightweight, engine that can operate at high speeds, is more efficient, and can be placed in an advantageous lower position in the frame of the motorcycle. As a consequence, a lighter, lower, more maneuverable motorcycle which has better aerodynamic characteristics, consumes less fuel, has better acceleration, and has a potentially higher maximum speed will result.

One of the overall advantages of the present invention is the freedom of design which the various novel combinations of structural features provide. The basic design may have many different applications as described herein, but it should be understood that the number of potential applications is limited only by the imagination of the designer and it is particularly suited for reciprocating machines of all types, including pumps.

The present invention also finds particular application to light aircraft with piston engines, especially very light aircraft using engines of one cylinder where the low vibration of the mechanism will allow an even lighter structure for the aircraft without risk of fracture, and where the compact form can reduce the frontal area. A particular benefit of the mechanism for aircraft having engines of only one cylinder is the annulment of gyroscopic effects due to the counter rotation of the two crankshafts. As with motorcycles, the aircraft may change direction without the influence of this particular engine effect.

The present invention finds further application in the field of hybrid electric vehicles where the availability of four crankshaft ends provides for driving not only the components for function of the engine, but also a generator and the vehicle itself directly.

It should be understood that the above description discloses specific embodiments of the present invention and are for purposes of illustration only. There may be other modifications and changes obvious to those of ordinary skill in the art that fall within the scope of the present invention which should be limited only by the following claims and their legal equivalents.

What is claimed is:

1. An internal combustion engine, comprising:

two phased-together parallel crankshafts, each having a crankpin and a first and a second connecting rod operating in the same plane, each connecting rod rotationally affixed to one of said crankpins;

a piston having two wristpins, each wristpin attached to one of said connecting rods, whereby said piston reciprocates within a cylinder between top and dead center positions as said crankshaft rotates; and said connecting rods further described in that the inner-facing side surface of said first connecting rod is compatible with the inner side surface of said second connecting rod so that portions of each rod overlap at the point of the rotational cycle of said crankshaft where the connecting rods are at their point of maximum proximity.

2. The internal combustion engine of claim 1, wherein said connecting rods include male and female profiles along their inner side surfaces, such that said rods nest together.

3. The internal combustion engine of claim 2, wherein said connecting rods have an arced lateral profile.

4. The internal combustion engine of claim 3, further described in that said connecting rod is composed of a composite fiber material to provide a controlled flexure of the connecting rod when under both tension and compression as said piston changes direction.

* * * * *